US007442062B2

(12) United States Patent
Sasaki et al.

(10) Patent No.: US 7,442,062 B2
(45) Date of Patent: Oct. 28, 2008

(54) FLUORESCENT TUBE CONNECTOR DEVICE, LIGHT SOURCE DEVICE, AND DISPLAY

(75) Inventors: Toshinori Sasaki, Fukushima (JP); Shuichi Endo, Fukushima (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/850,452

(22) Filed: Sep. 5, 2007

(65) Prior Publication Data

US 2008/0076284 A1 Mar. 27, 2008

(30) Foreign Application Priority Data

Sep. 7, 2006 (JP) ..... 2006-242917

(51) Int. Cl.
*H01R 33/02* (2006.01)

(52) U.S. Cl. ..... 439/226

(58) Field of Classification Search ..... 439/225, 439/280, 336, 241, 189, 511, 242, 231, 226–229, 439/236, 414, 356, 619, 817, 683, 699.2, 439/699.1, 660, 819, 246, 235, 243, 436–441; 362/221, 260, 217, 226, 216

See application file for complete search history.

(56) References Cited

U.S. PATENT DOCUMENTS 3,771,106 A * 11/1973 Matsumoto et al. ..... 439/23
5,816,837 A * 10/1998 Henrici et al. ..... 439/231
6,213,816 B1 * 4/2001 Meichsner et al. ..... 439/699.2
6,431,895 B1 * 8/2002 Hung ..... 439/241

FOREIGN PATENT DOCUMENTS

JP 09-259749 10/1997

* cited by examiner

*Primary Examiner*—Edwin A. León
(74) *Attorney, Agent, or Firm*—Sonnenschein Nath & Rosenthal LLP

(57) ABSTRACT

A fluorescent tube connector device includes a plurality of connection terminals corresponding to a plurality of electrode pins provided at one end of a fluorescent tube, wherein the plurality of connection terminals are fixed by a molded case, and the molded case has a rib for insulating the plurality of connection terminals from each other.

4 Claims, 6 Drawing Sheets

FLUORESCENT TUBE CONNECTOR DEVICE, LIGHT SOURCE DEVICE, AND DISPLAY

CROSS REFERENCES TO RELATED APPLICATIONS

The present invention contains subject matter related to Japanese Patent Application JP 2006-242917 filed with the Japan Patent Office on Sep. 7, 2006, the entire contents of which being incorporated herein by reference.

BACKGROUND OF THE INVENTION

1. Field of the Invention

The present invention relates to a fluorescent tube connector device, a light source device having the fluorescent tube connector device, and a display having the light source device.

2. Description of the Related Art

In flat-type displays called "flat panel displays (FPD)" such as liquid crystal displays, a light source device for general illumination and a light modulating element (for example, a liquid crystal element in a liquid crystal display) are provided, and a predetermined light output can be made by a combination of the light source device and the light modulating element.

A variety of investigations have been made as to the configuration and kind of the light source device. In recent years, utilization of a fluorescent tube has been being deemed as promising, from the viewpoints of luminous efficiency, color gamut, long-term reliability, and the like.

Particularly, the hot cathode type fluorescent tube has been paid attention to because of its high luminous efficiency and high luminance. In a hot cathode type fluorescent tube, electrodes are provided at both end parts of a glass tube, a gas (such as argon gas) and mercury are sealed in the space inside the glass tube, and the internal surface of the glass tube is coated with a fluorescent material.

Meanwhile, in the case where fluorescent tubes including cold cathode tubes are incorporated into light source devices or the like, it may generally be necessary to electrically connect electrode pins at an end part or parts of the fluorescent tube to a peripheral apparatus. This connection has been made by a technique shown in FIG. 7 in which a wire extending from the peripheral apparatus is wound around the electrode pin of the fluorescent tube, and, after this operation or the like operation, the wire wound around the electrode pin is fixed by soldering.

It has been pointed out, however, that the connection part formed by this technique involves the problem of a kinetic load tending to be exerted on the wire, possibly resulting in an inconvenience in electrical characteristics due to wearout or breaking of the wire. In addition, the connection part formed by this technique would be larger than necessary, due to the wound wire and the solder.

On the other hand, there has been proposed a technique in which an electrode pin and a wire are inserted into and fixed in a connector, followed by calking, soldering or the like operation to thereby connect the electrode pin and the wire to each other (refer to, for example, Japanese Patent Laid-open No. Hei 9-259749).

With this technique, however, it is difficult to cope with another problem which is generated, particularly, in a hot cathode tube.

As shown in FIG. 8, a hot cathode tube has a structure in which two electrode pins are projecting in parallel at one end part of a fluorescent tube. In an extremely small diameter hot cathode tube constituting an FPD, the spacing between the two electrode pins is particularly small. Therefore, an attempt to fix the electrode pins by soldering may result in that the solder portions applied individually to the electrode pins make contact with each other, causing unnecessary electrical connection between the electrode pins.

For example, where the spacing between the electrode pins is only 0.7 mm on a center-to-center basis, the actual gap between the electrode pins obtained by subtracting the radii of the electrode pins is 0.4 mm, so that shortcircuit may not be obviated when the width of the wire is greater than 0.4 mm. In addition, even where the width of the wire is small, in order to obviate the electrical contact between the closely disposed electrode pins in the manufacturing process, it has been needed to adopt a method which is intricate to carry out manually and is low in assuredness, such as a method in which soldering for one of the electrode pins disposed side by side is conducted while covering the other.

SUMMARY OF THE INVENTION

Thus, there is a need for a connector device for a fluorescent tube having a plurality of electrode pins at one end thereof by which it is possible to obviate the generation of an unnecessary electrical connection between the electrode pins, for a light source device including the fluorescent tube connector device, and for a display including the light source device.

According to one embodiment of the present invention, there is provided a fluorescent tube connector device including a plurality of connection terminals corresponding to a plurality of electrode pins provided at one end of a fluorescent tube, wherein the plurality of connection terminals are fixed by a molded case, and the molded case has a rib for insulating the plurality of connection terminals from each other.

According to another embodiment of the present invention, there is provided a light source device including a fluorescent tube connector device, wherein the fluorescent tube connector device includes a plurality of connection terminals corresponding to a plurality of electrode pins provided at one end of a fluorescent tube, the plurality of connection terminals are fixed by a molded case, and the molded case has a rib for insulating the plurality of connection terminals from each other.

According to a further embodiment of the present invention, there is provided a display including a light source device, wherein the light source device has a fluorescent tube connector device, the fluorescent tube connector device includes a plurality of connection terminals corresponding to a plurality of electrode pins provided at one end of a fluorescent tube, the plurality of connection terminals are fixed by a molded case, and the molded case has a rib for insulating the plurality of connection terminals from each other.

In accordance with the fluorescent tube connector device based on the present invention, the plurality of connection terminals are fixed by the molded case, and the molded case has the ribs for insulating the plurality of connection terminals from each other. Therefore, even in the case of connecting the connector device to a fluorescent tube which has a plurality of electrode pins at one end thereof and in which the spacing between the plurality of electrode pins is particularly small, it is possible to obviate the generation of unnecessary electrical connection between the electrode pins.

In accordance with the light source device based on the present invention, it is possible to obviate the generation of unnecessary electrical connection between the electrode pins closely disposed at one end of a fluorescent tube, in the fluorescent tube connector device constituting the light source device. Therefore, a stable operation of the fluorescent tube serving as a light source can be promised, and long-term stability of the light source device is enhanced.

In accordance with the display based on the present invention, it is possible to obviate the generation of unnecessary electrical connection between the electrode pins closely disposed at one end of a fluorescent tube, in the fluorescent tube connector device constituting the display. Therefore, a stable operation of the fluorescent tube serving as a light source can be promised, and long-term stability of the display is enhanced.

DETAILED DESCRIPTION OF THE PREFERRED EMBODIMENTS

Figure 1A:
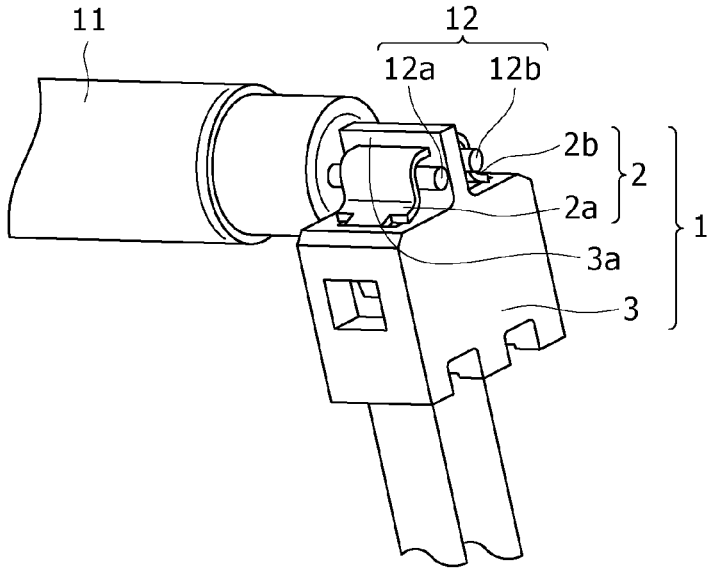
FIGS. 1A, 1B and 1C are respectively a perspective view, a side view as viewed in the longitudinal direction of a fluorescent tube, and a side view as viewed in a crosswise direction of the fluorescent tube, showing the configuration of an embodiment of a fluorescent tube connector device based on the present invention.

Now, an embodiment of the present invention will be described below referring to the drawings.

Embodiment of Fluorescent Tube Connector Device

First, an embodiment of the fluorescent tube connector device based on the present embodiment will be described.

Figure 1B:
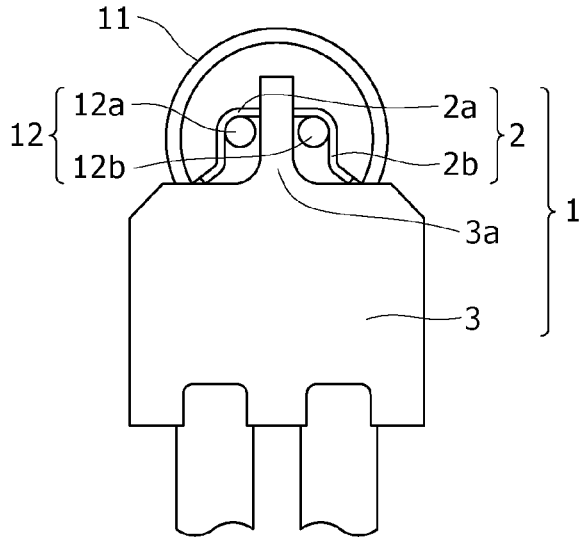
Figure 1C:
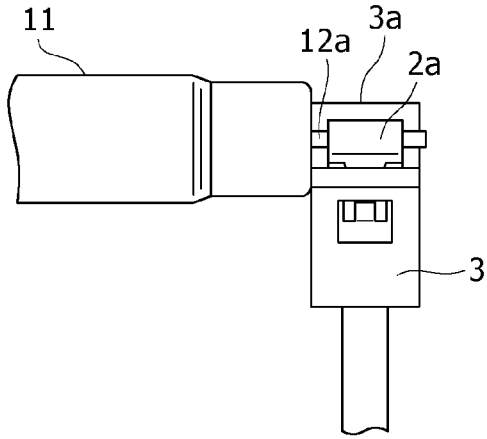

FIGS. 1A, 1B and 1C are respectively a perspective view, a side view as viewed in the longitudinal direction of a fluorescent tube, and a side view as viewed in a crosswise direction of the fluorescent tube, showing a fluorescent tube connector device in this embodiment in the state of being connected to a fluorescent tube.

As shown in FIG. 1A, the fluorescent tube connector device 1 in this embodiment has a plurality of connection terminals 2 corresponding to a plurality of electrode pins 12 provided at one end of a fluorescent tube 11. The plurality of connection terminals 2 are fixed by a molded case (bobbin) 3.

As shown in FIGS. lB and lC, the molded case 3 has a rib (wall-like projected part) 3*a* for insulating the plurality of connection terminals 2 from each other. An upper end of the wall-like rib 3*a* is higher than an upper end of each of the plurality of connection terminals 2, so as to prevent the terminals' upper ends from coming into contact with one another. By the rib 3*a*, the plurality of connection terminals 2 (in this embodiment, a first connection terminal 2*a* and a second connection terminal 2*b* ) are insulated and separated from each other physically and electrically.

In this embodiment, the fluorescent tube 11 for which the fluorescent tube connector device 1 is used is a hot cathode tube, and the connection terminals 2*a* and 2*b* are provided as two connection terminals, correspondingly to two electrode pins (a first electrode pin 12*a* and a second electrode pin 12*b*) provided at one end of the fluorescent tube 11.

Thus, the fluorescent tube connector device 1 in this embodiment has at least the connection terminals 2 in a number corresponding to the number of the electrode pins 12 provided at one end of the fluorescent tube 11, and, after attached to the fluorescent tube 11, it integrally constitutes an apparatus (a light emitting apparatus based on the fluorescent tube).

Figure 2:
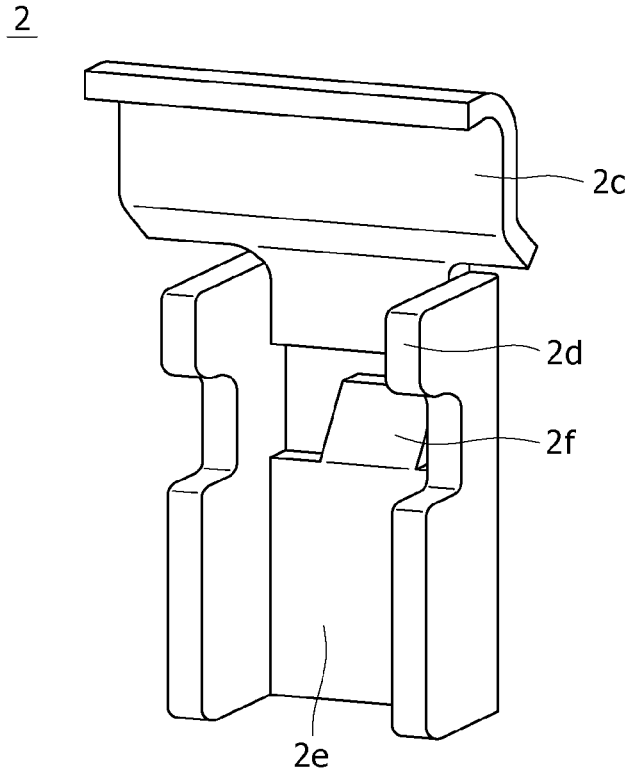
FIG. 2 is a perspective view of a connection terminal, in the configuration of the embodiment of the fluorescent tube connector device based on the present invention.

FIG. 2 is a perspective view of the connection terminal 2 constituting the fluorescent tube connector device 1 in this embodiment.

In the fluorescent tube connector device 1 in this embodiment, the connection terminal 2 (each of the first connection terminal 2*a* and the second connection terminal 2*b* ) is an elastic hook-shaped terminal as shown in FIG. 2.

The hook-like shape is disposed in such an orientation that, as shown in FIG. 1A, a hook-shaped curved inside surface 2*c* of the fluorescent tube connector device 1 faces the rib 3*a* of the molded case 3. The space through which the curved inside surface 2*c* and the rib 3*a* of the molded case 3 are opposed to each other serves as a space in which to insert the electrode pin 12 (each of the first electrode pin 12*a* and the second electrode pin 12*b*) of the fluorescent tube 11.

Figure 3:
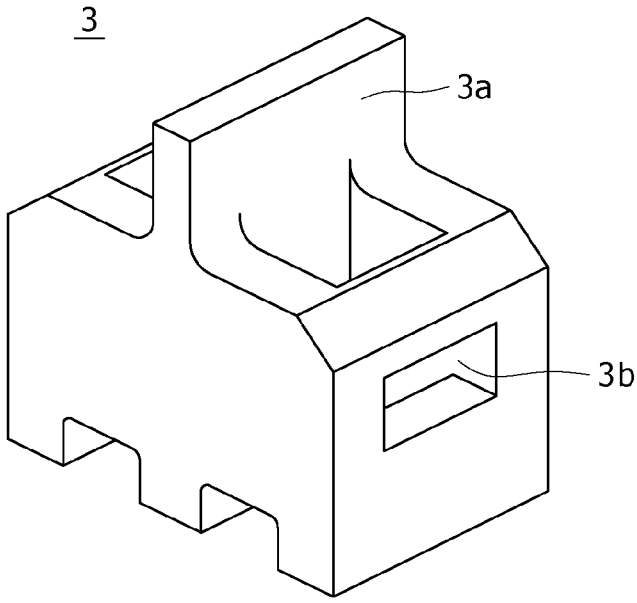
FIG. 3 is a perspective view of a molded case, in the configuration of the embodiment of the fluorescent tube connector device based on the present invention.

FIG. 3 is a perspective view of the molded case 3 constituting the fluorescent tube connector device 1 in this embodiment.

In the connection terminal 2, at least the hook-shaped part inclusive of the curved inside surface 2*c* is formed of an elastic material, or is configured to have elasticity by incorporating a structure (not shown) capable of minute driving.

In the connection terminal 2 thus configured to be elastic, at least the hook-shaped part is provided at such position and angle that a force directed toward the rib 3*a* of the molded case 3 is generated by the elasticity. This ensures that, when the electrode pin is inserted in the above-mentioned inserting space, sufficient contact between the connection terminal and the electrode pin can be secured, and the electrode pin can be restrained from dropping.

Incidentally, in this embodiment, the connection terminal 2 is provided with guides 2*d* so that the connection terminal 2 is fixed at predetermined position and angle when attached to the molded case 3.

In addition, an inside surface being continuous to the curved inside surface 2*c* side of the hook-shaped part and being along the guides 2*d* is made to be a wire space 2*e*; when the connection terminal 2 is actually attached to the molded case 3, the wire (not shown) is preliminarily disposed inside the wire space 2*e*.

Further, a molded case fixing member 2*f* is projectingly formed on the back side of the wire space 2*e*, i.e., on the outside opposite to the side on which the curved inside surface 2*c* and the guides 2*d* are arranged. The molded case fixing member 2*f* is so shaped and sized that it is fitted into a hole formed in a connection terminal fixing part 3*b* provided at each side surface of the molded case 3.

Here, an example of the method of manufacturing the fluorescent tube connector device in this embodiment and an example of the method of attaching the fluorescent tube connector device to a fluorescent tube will be described below.

Figure 4:
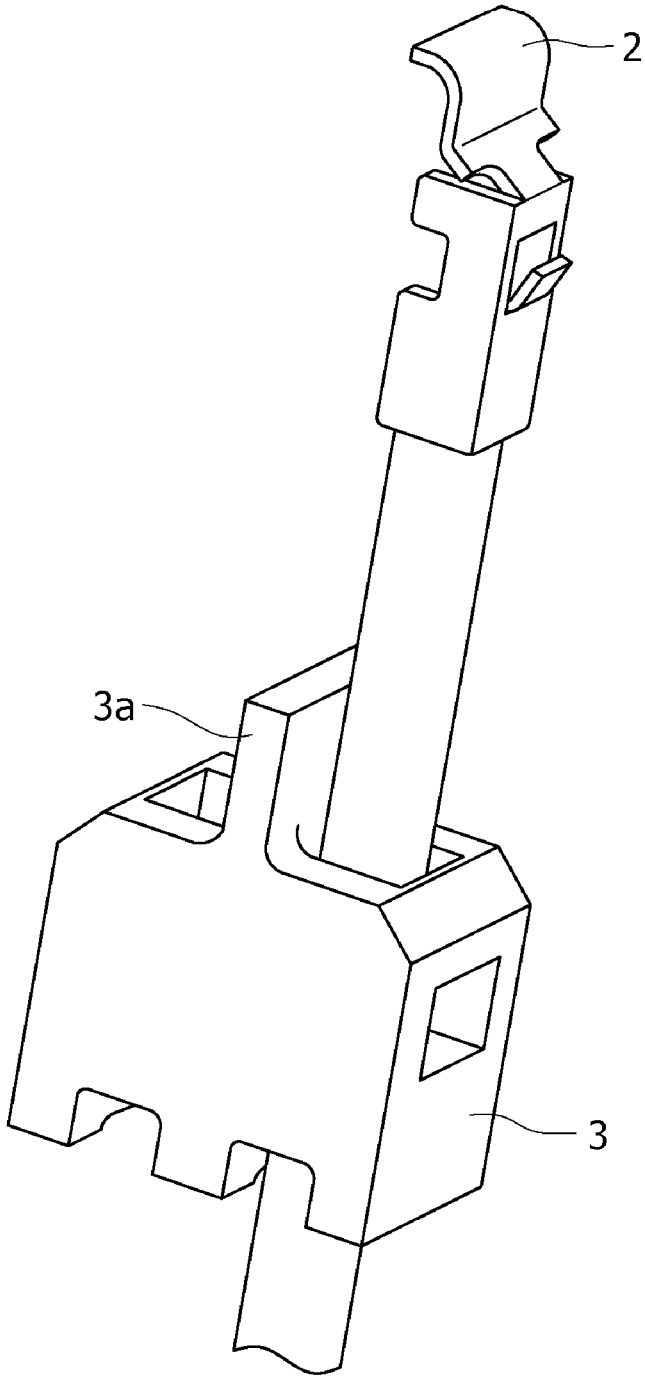
FIG. 4 is a perspective view of the connection terminal and the molded case, for illustrating a manufacturing method, in the configuration of the embodiment of the fluorescent tube connector device based on the present invention.

FIG. 4 is a perspective view of a connection terminal and a molded case, for illustrating the method of manufacturing the fluorescent tube connector device based on this embodiment.

As above-mentioned, the attaching operation in this example is conducted by a method in which the connection terminal 2 with an end part of a wire disposed in the wire space 2*e* is fixed to the molded case 3 by fitting the molded case fixing member 2*f* fitted into the hole in the connection terminal fixing part 3*b*, whereby the fluorescent tube connector device 1 is manufactured integrally. The fluorescent tube connector device 1 thus obtained has box-like structures on the left and right sides of the rib 3*a*, so that after the electrical connection with the fluorescent tube is formed as will be described later, the connected members would not easily be released.

Here, the connection between the wires and the connection terminals 2 may be conducted simultaneously with or prior to the fixation to the molded case 3. Since the connected members are configured finally as an assembly, the rib 3*a* can be made large in overall shape, whereby an enhanced strength and smoother insertion of electrode pins are promised. This can restrain the deformation which may be generated where the rib 3*a* is thin (at the time of insertion of the electrode pin, or the like). Incidentally, especially where the connection terminal 2 is small, it is preferable, in consideration of deformation and/or workability, to manufacture the fluorescent tube connector device 1 by a procedure in which wires are passed through the molded case 3, and thereafter the connection terminals 2 are connected to the wires projected to the upper side where the rib 3*a* is located.

In addition, the space through which the curved inside surface 2*c* and the rib 3*a* are opposed to each other and which serves as the space into which to insert the electrode pin 12 is preferably formed to have an allowance in the height direction (in the protruding direction of the rib 3*a*) as compared with the size of the electrode pin 12 itself. This permits the electrode pin 12 to be rotated by, for example, ±30°, whereby an easy insertion and a reduction in the load exerted on the connection terminal 2 and the electrode pin 12 after the insertion can be promised.

Subsequent to the manufacture of the fluorescent tube connector device 1, end parts of the wires, the connection terminals 2 and the electrode pins of the fluorescent tube are electrically connected.

Figure 5:
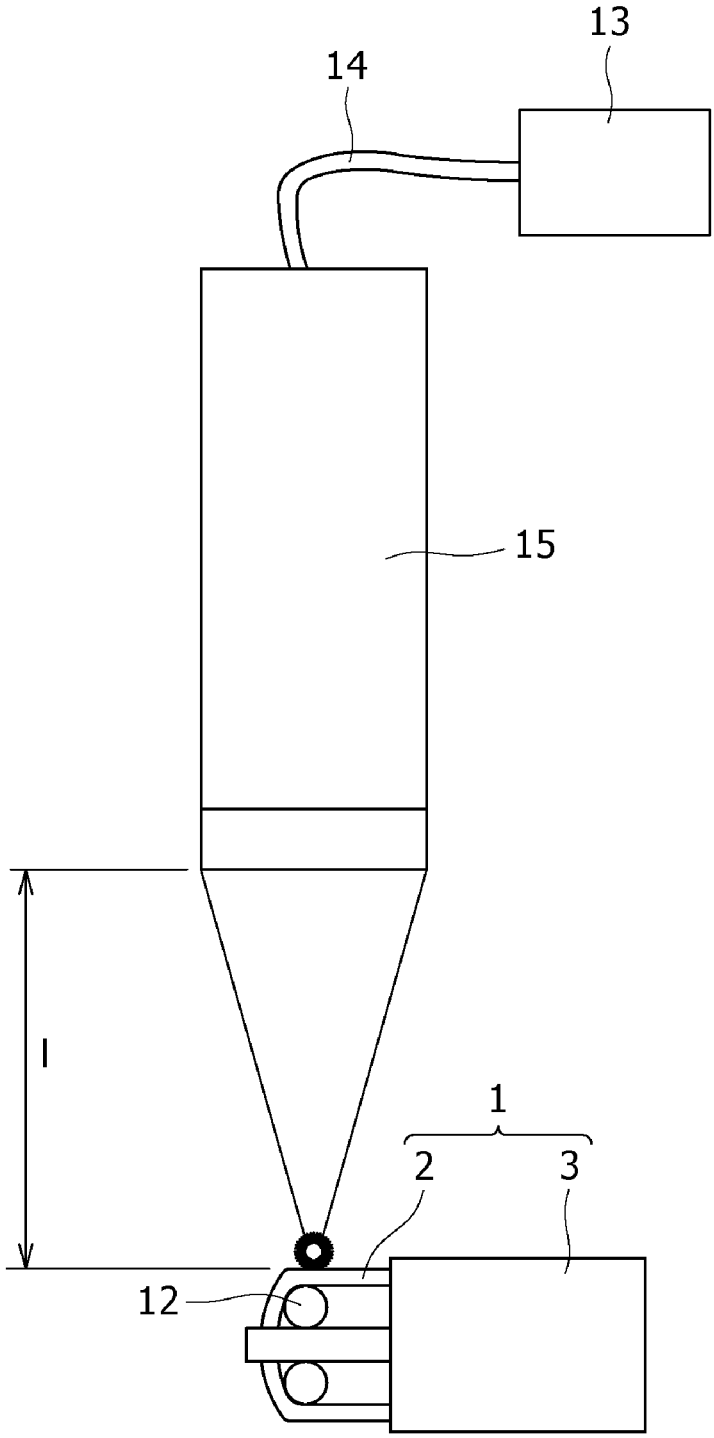
FIG. 5 is a schematic view of laser welding, for illustrating a manufacturing method, in the configuration of the embodiment of the fluorescent tube connector device based on the present invention.

The formation of the electrical connections can be conducted, for example, by laser welding by use of a welding machine having a laser light source 13, a laser fiber 14, and a condensing optical system 15, as shown in FIG. 5. Specific exemplary conditions of the laser welding include a diameter of the laser fiber 14 of 0.2 mm, a focal distance (distance 1 in the figure) of 56 mm, a thickness of the connection terminal 2, made of iron or stainless steel (SUS), of 0.1 mm.

In this manner, the wires and the electrode pins are electrically connected through the integrally formed fluorescent tube connector device 1.

Here, the technique for electrically connecting the connection terminals 2 of the fluorescent tube connector device 1 in this embodiment, the end parts of the wires, and the electrode pins 12 of the fluorescent tube 11 is not limited to the laser welding; for example, a technique may be adopted in which a solder is made to flow to the sides of the curved inside surfaces of the connection terminals 2*a* and 2*b*, i.e., to the gaps between the connection terminals 2*a*, 2*b* and the molded case 3 (the rib 3*a*). In specific exemplary conditions of soldering, the connection terminals 2 are made of phosphor bronze in a thickness of 0.1 mm.

In the case of achieving the electrical connection by soldering, also, the use of the fluorescent tube connector device 1 according to this embodiment makes it possible to easily achieve the electrical connection by flowing a solder.

Both in the case of laser welding and in the case of soldering, the formation of the electrical connections can be carried out appropriately and easily by the process in which the wires, the connection terminals 2 and the molded case 3 are formed to be an integral assembly.

Thus, according to the fluorescent tube connector device 1 in this embodiment, the desired electrical connections can be formed easily and assuredly, without depending on a technique which is intricate to carry out manually and is low in assuredness, as in the related art.

Embodiment of Light Source Device and Display

Now, an embodiment of a light source device having the fluorescent tube connector device according to the above-described embodiment, and a display having the light source device, will be described below.

Displays are generally classified into the underneath (direct) system and the edge light (side light) system, according to the system in which a light source device having a fluorescent tube is disposed.

The underneath system has a configuration in which a light source device having a plurality of fluorescent tubes is provided at a back surface (rear surface) opposite to a display surface (front surface). Since the light from the light source device can be utilized directly, the underneath system is said to be advantageous in realizing a higher luminance, a higher efficiency and a larger size, but it is difficult to reduce in thickness and it consumes much power.

On the other hand, the edge light system has a configuration in which a plate-like light guide part (light guide) made of an acrylic resin, for example, and a light source device are disposed at the back surface opposite to the display surface. Since light is diffused by the light guide part, the edge light system is said to be advantageous in realizing a smaller size, a smaller thickness and a smaller power consumption, but its weight matters in the case of a large-screen display. Incidentally, the edge light system is classified further into the back light type in which the position of the light source device is on the back side relative to the light guide part, and the front light type in which the position of the light source device is on the front side relative to the light guide part and which is designed on the assumption that reflected light is generated at an optical element.

In this embodiment, description will be made of an exemplary case in which a light source device having fluorescent tubes and fluorescent tube connector devices is disposed as a back light in the underneath system in configuring the display.

Figure 6:
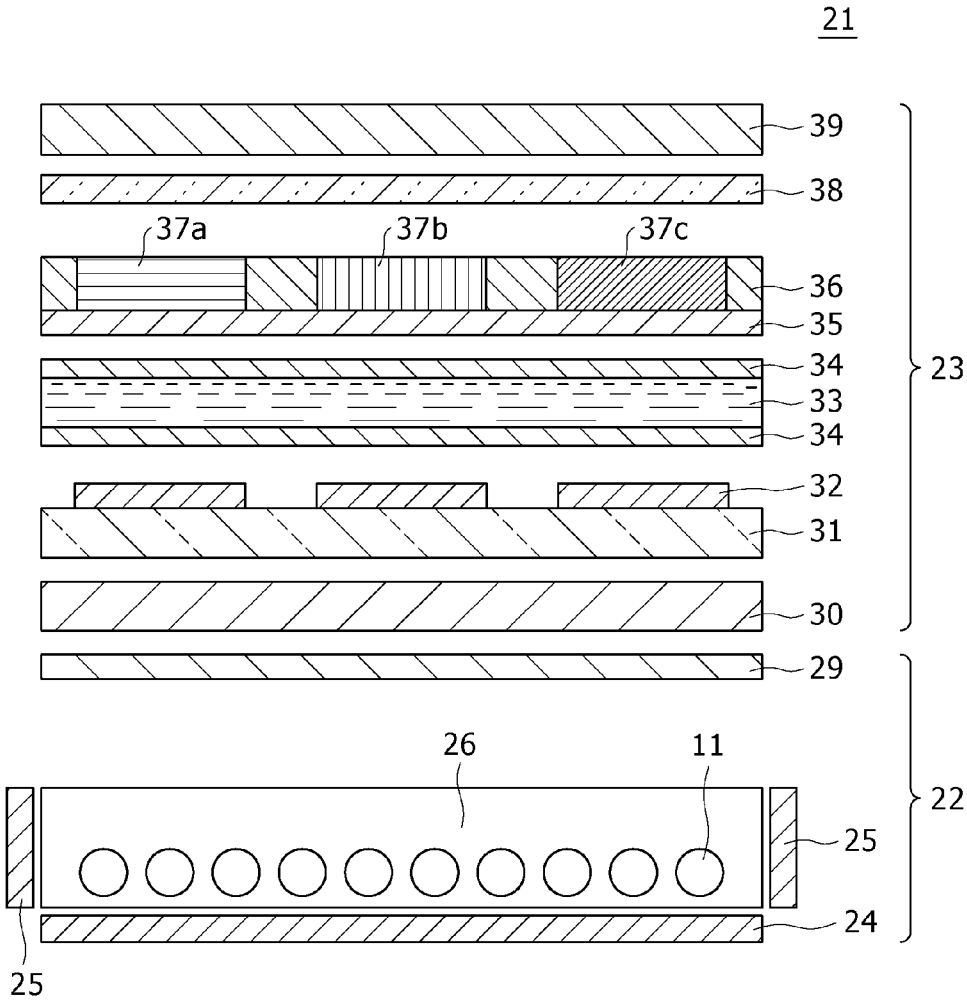
FIG. 6 is a schematic view illustrating the configuration of an embodiment of a light source device and a display based on the present invention.
Figure 7:
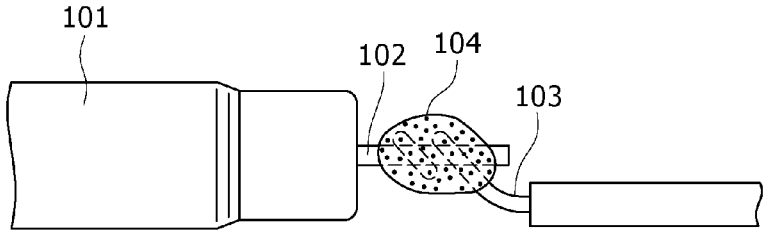
FIG. 7 is a schematic view illustrating the connection between an electrode pin and a wire in a fluorescent tube according to the related art.
Figure 8A:
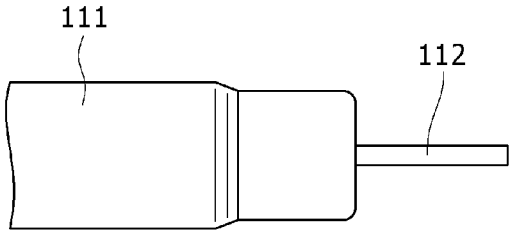
FIGS. 8A and 8B are respectively a side view as viewed in a crosswise direction, and a side view as viewed in the longitudinal direction, of a fluorescent tube according to the related art.
Figure 8B:
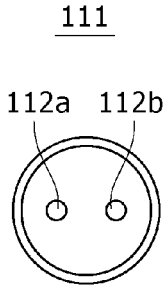

FIG. 6 is a schematic view of a light source device according to this embodiment, and a display having the light source device.

The display 21 in this embodiment has a light source device 22. Fluorescent tubes 11 are disposed and fixed, by the above-described manufacturing method, in a resin-made light guide part 26 of the light source device 22. More specifically, the fluorescent tubes 11 are electrically connected inside the light source device 22 by use of fluorescent tube connector devices 1 (not shown) according to the above-described embodiment.

In this embodiment, a diffuser sheet 29 is provided at a most closely disposed part, facing an optical device 23, of the light source device 22. The diffuser sheet 29 is for leading the light from the fluorescent tubes 11, evenly on a plane basis (surface light source basis) toward the optical device 23 side. A reflector 24 is provided on the rear side of the light source device 22. Besides, if necessary, a reflector 25 similar to the reflector 24 is provided also at each side surface of the light guide part 26.

Incidentally, in the light source device 22 according to this embodiment, examples of the resin constituting the light guide part 26 include various transparent resins, in addition to epoxy resins, silicone resins, and urethane resins.

In addition, the display 21 has the optical device (e.g., liquid crystal device) 23 which outputs predetermined output light by modulating the light from the light source device 22. The light source device 22 is provided on the back side relative to the optical device 23, and light is supplied to the optical device 23 from the light source device 22 serving as a back light of the so-called underneath system.

In this optical device 23, a polarizing plate 30, a glass substrate 31 for TFT (Thin Film Transistor) and dot-shaped electrodes 32 on its surface, a liquid crystal layer 33 and orienting films 34 covering its face side and back side, electrodes 35, a plurality of black matrices 36 on the electrodes 35, a first (red) color filter 37*a*, a second (green) color filter 37*b* and a third (blue) color filter 37*c* corresponding to pixels provided between the black matrices 36, a glass substrate 38 separate from the black matrices 36 and the color filters 37*a* to 37*c*, and a polarizing plate 39 are sequentially disposed in this order from the light source device 22 side.

Here, the polarizing plates 30 and 39 are for forming light vibrating in a specified direction. In addition, the TFT glass substrate 31, the dot-shaped electrodes 32 and the electrodes 35 are provided for switching the liquid crystal layer 33 transmitting only the rays of light vibrating in specified directions; with the orienting films 34 provided in combination with these members, the orientations of the liquid crystal molecules in the liquid crystal layer 33 are aligned into a fixed direction. Besides, since the black matrices 36 are provided, enhancement of the contrast of the light outputted from the color filters 37*a* to 37*c* corresponding to the colors is contrived. Incidentally, the black matrices 36 and the color filters 37*a*, 37*c* are attached to the glass substrate 38.

According to the light source device and the display in this embodiment, it is possible to obviate the generation of unnecessary electrical connection between the electrode pins closely disposed at one end of each of the fluorescent tubes, in the fluorescent tube connector devices constituting the device. Therefore, a stable operation of the fluorescent tubes serving as light source is contrived, whereby the long-term stability of the device is enhanced.

As has been mentioned in the above embodiments and examples, according to the fluorescent tube connector device based on the present invention, even where the device is connected to a fluorescent tube which has a plurality of electrode pins at one end thereof and in which the spacing between the plurality of electrode pins is particularly small, it is possible to obviate the generation of unnecessary electrical connection between the electrode pins.

In addition, according to the fluorescent tube connector device in the present embodiment, the desired electrical connections can be formed easily and assuredly, without depending on a technique which is intricate to carry out manually, is attended by a reduction in productivity and is low in assuredness, as in the related art.

Besides, according to the light source device and the display which use this fluorescent tube connector device, it is possible to obviate the generation of unnecessary electrical connection between the electrode pins closely disposed at one end of each fluorescent tube, in the fluorescent tube connector device constituting these devices. Therefore, a stable operation of the fluorescent tubes serving as light source is contrived, whereby the long-term stability of these devices is enhanced.

In addition, according to the fluorescent tube connector device in the present embodiment, the connection part which would become larger than necessary due to the solder in the technique according to the related art can be reduced to a fixed size (e.g., a size comparable to that in a cold cathode tube) by restricting the soldering area to the space between a connection terminal and a rib. As a result, it is possible to prevent the connection part from having an influence on the set outside shape of the light source device or the like.

Besides, since the connection terminals and the molded case serve for reinforcing (protecting) the electrode pins and wires, the electrode pins and wires can be restrained from being broken. Incidentally, it is considered that, where the electrical connections are formed by laser joining, enhancement of joint strength can also be contrived.

Incidentally, in the fluorescent tube connector device according to the present embodiment, when the electrical connections are formed by laser welding as above-mentioned, oxidation of the surfaces of the electrode pins does not have any influence on the electrical connection and, therefore, such steps as a step of removing an oxide layer can be omitted. On the other hand, where the electrical connections are formed by soldering, removal of an oxide film may be required; however, in this case, also, the assuredness and efficiency of soldering can be enhanced. In short, according to the fluorescent tube connector device in the present embodiment, improvements in workability and productivity in the manufacturing process can be promised both in the case of forming the electrical connections by laser welding and in the case of forming the electrical connections by soldering.

While the example of the underneath system has been described in the embodiments above, the light source devices and the displays of the edge light system are advantageous in realizing a smaller thickness and, hence, is tending to be used for displays of personal computers (of the notebook type, for example). In the edge light system, however, the fluorescent tubes may be extremely small in diameter. Therefore, where the fluorescent tubes pertaining to the present embodiment are provided in the light source device and the display of the edge light system, the mounting of the fluorescent tubes extremely small in diameter is enabled by the fluorescent tube connector device according to the present embodiment, especially effectively.

While some embodiments of the fluorescent tube connector device, the light source device, and the display based on the present invention have been described above, the materials used and the numerical value conditions of the amount of material, treating time, dimensions and the like mentioned in the above description are merely preferred examples, and the dimensions, shapes and positional relationships in the drawings used for the description are also merely schematic examples. Thus, the present invention is not to be construed as limited to the embodiments.

It should be understood by those skilled in the art that various modifications, combinations, sub-combinations and alterations may occur depending on design requirements and other factors insofar as they are within the scope of the appended claims or the equivalents thereof.

What is claimed is:

1. A fluorescent tube connector device comprising:

a plurality of connection terminals corresponding to a plurality of electrode pins provided at one end of a fluorescent tube, wherein, said plurality of connection terminals are fixed by a molded case, said molded case has a rib for insulating said plurality of connection terminals from each other, at least one of said plurality of connection terminals is an elastic hook-shaped terminal, and a space through which a curved inside surface of said hook shape and said rib of said molded case are opposed to each other is a space into which said electrode pin is inserted, and an upper end of said rib is higher than an upper end of each of said plurality of connection terminals, so as to prevent said upper ends of said plurality of connection terminals from coming into contact with one another.

2. The fluorescent tube connector device as set forth in claim 1, wherein said connection terminals and said electrode pins are connected to each other by welding.

3. A light source device comprising:

a fluorescent tube connector device, said fluorescent tube connector device having a plurality of connection terminals corresponding to a plurality of electrode pins provided at one end of a fluorescent tube, wherein, said plurality of connection terminals are fixed by a molded case, and said molded case has a rib for insulating said plurality of connection terminals from each other, at least one of said plurality of connection terminals is an elastic hook-shaped terminal, and a space through which a curved inside surface of said hook shape and said rib of said molded case are opposed to each other is a space into which said electrode pin is inserted, and an upper end of said rib is higher than an upper end of each of said plurality of connection terminals, so as to prevent said upper ends of said plurality of connection terminals from coming into contact with one another.

4. A display comprising a light source device, wherein said light source device has a fluorescent tube connector device, said fluorescent tube connector device having a plurality of connection terminals corresponding to a plurality of electrode pins provided at one end of a fluorescent tube, wherein, said plurality of connection terminals are fixed by a molded case, and said molded case has a rib for insulating said plurality of connection terminals from each other, at least one of said plurality of connection terminals is an elastic hook-shaped terminal, and a space through which a curved inside surface of said hook shape and said rib of said molded case are opposed to each other is a space into which said electrode pin is inserted, and an upper end of said rib is higher than an upper end of each of said plurality of connection terminals, so as to prevent said upper ends of said plurality of connection terminals from coming into contact with one another.

* * * * *